US010246852B2

(12) United States Patent
DeWind et al.

(10) Patent No.: US 10,246,852 B2
(45) Date of Patent: Apr. 2, 2019

(54) BOOM ASSEMBLY FOR A TRENCHER

(71) Applicant: DeWind One-Pass Trenching, LLC, Zeeland, MI (US)

(72) Inventors: Gregory Allen DeWind, Zeeland, MI (US); Ryan DeWind, Zeeland, MI (US)

(73) Assignee: Dewind One-Pass Trenching LLC, Zeeland, MI (US)

( * ) Notice: Subject to any disclaimer, the term of this patent is extended or adjusted under 35 U.S.C. 154(b) by 0 days.

(21) Appl. No.: 15/593,589

(22) Filed: May 12, 2017

(65) Prior Publication Data

US 2018/0328001 A1 Nov. 15, 2018

(51) Int. Cl.

| | |
|---|---|
| ***E02F 5/06*** | (2006.01) |
| ***E02F 5/14*** | (2006.01) |
| ***E02F 9/20*** | (2006.01) |
| ***E02F 9/22*** | (2006.01) |

(52) U.S. Cl.

CPC ..... *E02F 5/14* (2013.01); *E02F 5/06* (2013.01); *E02F 9/202* (2013.01); *E02F 9/22* (2013.01)

(58) Field of Classification Search

CPC ..... E02F 3/08; E02F 3/12; E02F 3/145; E02F 5/02; E02F 5/06; E02F 9/20

USPC ..... 37/352, 355, 362, 364, 365

See application file for complete search history.

(56) References Cited

U.S. PATENT DOCUMENTS

| | | | | | |
|---|---|---|---|---|---|
| 645,752 | A * | 3/1900 | MacKey | E02F 3/08 | 37/362 |
| 1,019,242 | A * | 3/1912 | Frechette | E02F 3/08 | 37/354 |
| 1,186,036 | A * | 6/1916 | Poulter | E02F 3/08 | 198/712 |
| 1,460,762 | A * | 7/1923 | Miller | E02F 3/08 | 37/107 |
| 2,069,712 | A * | 2/1937 | Penote | E02F 3/08 | 37/355 |
| 2,196,513 | A * | 4/1940 | Adler | E02F 3/18 | 37/104 |
| 2,237,773 | A * | 4/1941 | Van Voorhis | E02F 3/18 | 198/307.1 |
| 3,596,994 | A * | 8/1971 | Garden | E02F 3/08 | 171/14 |
| 4,409,747 | A * | 10/1983 | Kaldenbach | E02F 5/06 | 37/338 |
| 5,601,383 | A * | 2/1997 | Zanin | E02F 5/003 | 37/364 |
| 6,789,336 | B2 * | 9/2004 | Collins | E02F 5/06 | 37/352 |

* cited by examiner

*Primary Examiner* — Gary S Hartmann
(74) *Attorney, Agent, or Firm* — The Watson IP Group, PLC; Jovan N. Jovanovic

(57) ABSTRACT

A boom assembly for a trencher having a boom frame member, a boom drive assembly and a plurality of boom arm assemblies. The boom frame member configured to be attachable to the trencher. The boom drive assembly attached to the boom frame member, having an output shaft that is rotatably actuatable. The plurality of boom arm assemblies extending from the boom frame member, the plurality of boom arm assemblies including at least a first boom arm assembly and a second boom arm assembly. The first and second boom arm assemblies can be of differing length, width, angle and may operate at different speeds.

17 Claims, 8 Drawing Sheets

BOOM ASSEMBLY FOR A TRENCHER

CROSS-REFERENCE TO RELATED APPLICATION

N/A

BACKGROUND OF THE DISCLOSURE

1. Field of the Disclosure

The disclosure relates in general to trenching equipment, and more particularly, to a boom assembly for a trencher.

2. Background Art

The use of trenching equipment is known in the art. Trenching equipment can be utilized to, for example, form an underground wall (often referred to as a cutoff wall) which is a non-structural wall that can form a barrier to the movement of the groundwater thereacross. Typically, the existing soil is mixed with an outside material (usually a clay-like material such as bentonite, and/or cement) and then reintroduced into the trench. The outside material when mixed with existing soil forms a wall which provides for a barrier to the passage of groundwater. Of course, we are not limited to such materials.

In some instances, the required trench is a relatively narrow width which can be accomplished with a single pass of the trenching equipment. In other instances, however, multiple passes of the trencher are required for a single trench of greater width. The number of passes is not merely the trench width divided by the trenching width, as an overlap between adjacent passes is required. In some instances, such overlap can be, for example 15% to 50%. As will be appreciated, for wider trenches a significant number of passes of the trenching equipment is required.

Furthermore, in other instances, a trench may have different depth along the width thereof, or different requirements as to the manner and processing of the trench to be formed. As such, it may be necessary to utilize different trenching equipment, or to modify trenching equipment to address the different depths. Where the trenching is in a remote location, it may be difficult to have multiple different trenchers or additional sets of trenching equipment available on-site.

SUMMARY OF THE DISCLOSURE

The disclosure is directed to a boom assembly configured for use in association with a trencher. The boom assembly includes a boom frame member, a boom drive assembly and a plurality of boom arm assemblies. The boom frame member is configured to be attachable to the trencher. The boom drive assembly is attached to the boom frame member, and has an output shaft that is rotatably actuatable. The plurality of boom arm assemblies extend from the boom frame member, and the plurality of boom arm assemblies include at least a first boom arm assembly and a second boom arm assembly. The first boom arm assembly includes a first boom frame, a first upper boom sprocket and a first cutting assembly. The first boom frame has a proximal end and a distal end. The proximal end is positioned proximate the boom frame member with the distal end spaced therefrom. The first upper boom sprocket is rotatably powered by the output shaft. The first cutting assembly has a first cutting chain formed in a loop between the proximal end and the distal end of the first boom frame, which interacts with the first upper boom sprocket, so as to be driven by the first upper boom sprocket. Similarly, the second boom arm assembly includes a second boom frame, a second upper boom sprocket and a second cutting assembly. The second boom frame has a proximal end and a distal end. The proximal end is positioned proximate the boom frame member, with the distal end spaced apart therefrom. The second upper boom sprocket is rotatably powered by the output shaft. The second cutting assembly has a second cutting chain formed in a loop between the proximal end and the distal end of the second boom frame which interacts with the second upper boom sprocket, so as to be driven by the second upper boom sprocket.

In some configurations, the boom frame member comprises a frame enclosure defining a cavity, with the output shaft extending into the cavity of the frame enclosure.

In some configurations, the first upper boom sprocket and the second upper boom sprocket are positioned on the output shaft, and, in turn, rotate with the output shaft.

In some configurations, the boom assembly further includes a boom mount assembly and an intermediate shaft. The boom mount assembly is releasably coupled to the boom frame member. The intermediate shaft has a first end and a second end. The intermediate shaft is spaced apart from the output shaft and rotatably mounted to the boom mount assembly and coupled to the output shaft. At least one of the first and second upper boom sprockets are positioned on the intermediate shaft, to in turn, rotate with the intermediate shaft.

In some configurations, the first boom arm assembly and the second boom arm assembly are attached to the boom mount assembly, to, in turn, be releasably coupled to the boom frame member.

In some configurations, the first boom arm assembly further includes a first lower boom sprocket, with the first cutting chain meshing therewith. The first lower boom sprocket is positioned proximate the distal end of the first boom frame.

In some configurations, the second boom arm assembly further includes a second lower boom sprocket, with a second cutting chain meshing therewith. The second lower boom sprocket is positioned proximate the distal end of the second boom frame.

In some configurations, the first cutting chain further includes a plurality of cutting supports attached thereto and extending substantially transverse to the first boom frame. A plurality of cutting teeth are attached to each of the cutting supports.

In some configurations, the cutting supports have a width that is greater than a width of the first boom frame.

In some configurations, the first boom frame and the second boom frame are coplanar so as to be mounted in a side by side configuration.

In some configurations, the first boom frame has a length and the second boom frame has a length. The length of the first boom frame is different than the length of the second boom frame.

In some configurations, the boom assembly further includes a third boom arm assembly that includes a third boom frame, a third upper boom sprocket and a third cutting assembly. The third boom frame has a proximal end and a distal end. The proximal end is positioned proximate the boom frame member, with the distal end spaced apart therefrom. The third upper boom sprocket is rotatably powered by the output shaft. The third cutting assembly has a third cutting chain formed in a loop between the proximal end and the distal end of the third boom frame, and which interacts with the third upper boom sprocket, so as to be driven by the third upper boom sprocket.

In some configurations, the first boom frame, the second boom frame and the third boom frame are coplanar so as to be mounted in a side by side configuration.

In some configurations, the first boom frame has a length, the second boom frame has a length and the third boom frame has a length. The length of the first boom frame, the length of the second boom frame and the length of the third boom frame are each different.

In some configurations, the first upper boom sprocket has a diameter and the second upper boom sprocket has a diameter. The first upper boom sprocket has a diameter that is different than the second upper boom sprocket, to, in turn, impart a different linear velocity to the first cutting chain and the second cutting chain, respectively.

In some configurations, the boom drive member comprises a hydraulic motor.

In some configurations, at least one of the first boom frame and the second boom frame further includes an inner bore having a first end and a second end. The first end is positioned proximate the proximate end of the respective one of the first boom frame and second boom frame. The second end is spaced apart from the proximal end and toward the distal end of the respective one of the first boom frame and the second boom frame. The inner bore being structurally configured to receive a flowable material (such as a slurry including a clay-like material) therethrough.

In some configurations, each of the first boom frame and the second boom frame each further include an inner bore.

BRIEF DESCRIPTION OF THE DRAWINGS

The disclosure will now be described with reference to the drawings wherein.

DETAILED DESCRIPTION OF THE DISCLOSURE

Figure 1:
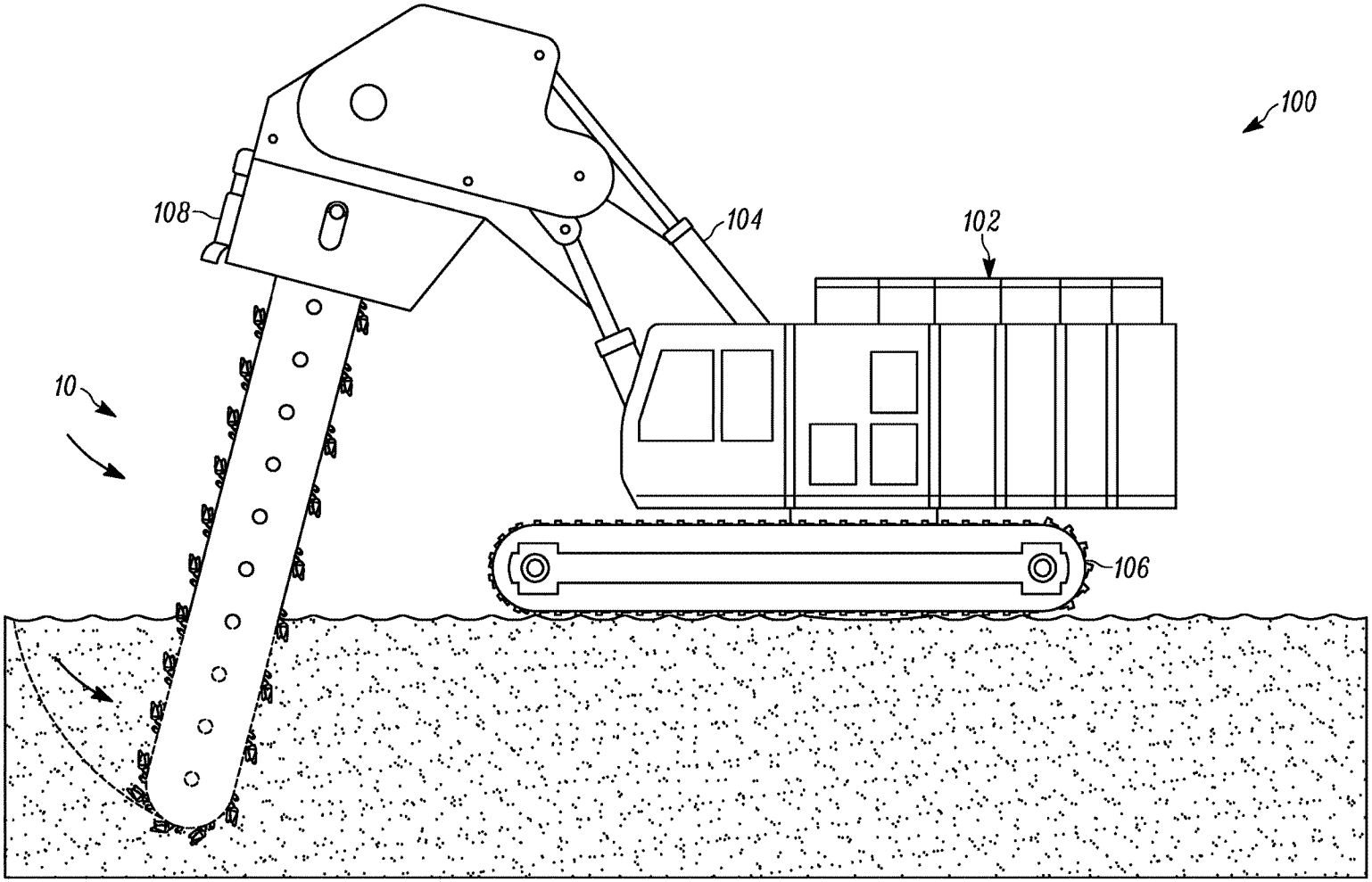
FIG. 1 of the drawings is a side elevational view of a schematic representation of a trencher in an operating environment.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the boom assembly for a trencher is shown generally at 10. The boom assembly is configured for use with a trencher, such as, for example, trencher 100. The trencher 100 generally includes a body 102 which includes a cab and the powering components (i.e., engine, transmission, hydraulic pumps, among other components), arm 104, tracks 106 (or other drive mechanism for transport) and auger or material feed member 108. Such trenching equipment can be of very large scale. For example, one such model, a model MT3500 manufactured by DeWind Dewatering of Holland, Mich., which is rated at 3,500 horsepower and which has a boom that may extend beyond 50 feet in length. Of course, the boom assembly is not limited to use with the particular trencher, much less a trencher having any particular features.

Figure 2:
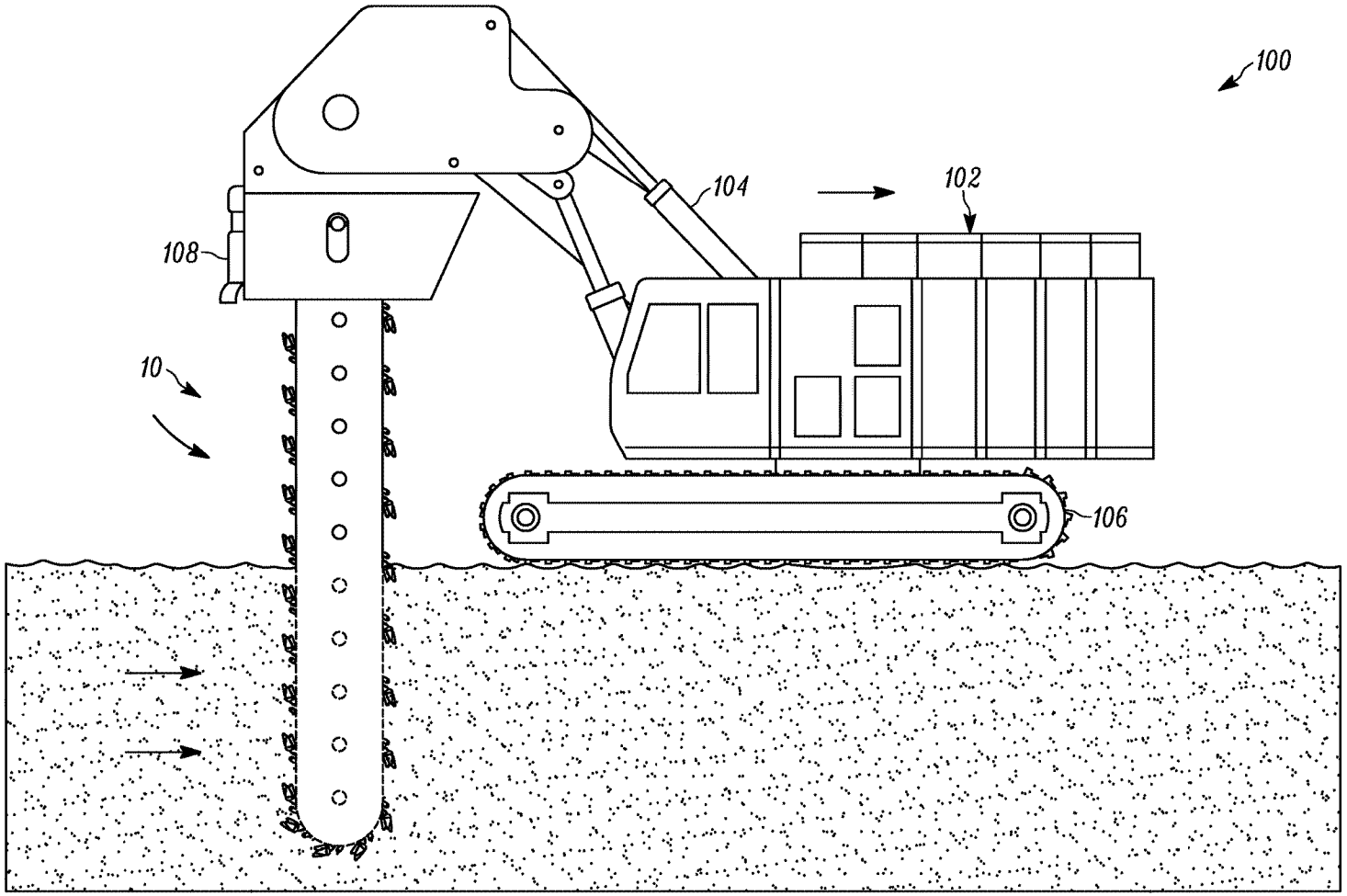
FIG. 2 of the drawings is a side elevational view of a schematic representation of a trencher in an operating environment.

As will be understood, and explained below, the boom 10 is configured to be inserted into the ground, as is shown in FIGS. 1 and 2, and once in the ground, the trencher 100 can be driven in the direction of the arrow to traverse the boom across the ground to form the trench. At the same time, material feed member 108 can pump and dispense various different materials (such as clay-like materials including bentonite and/or cement, or the like) at a desired flow rate so that the boom directs such material into the soil.

Figure 3:
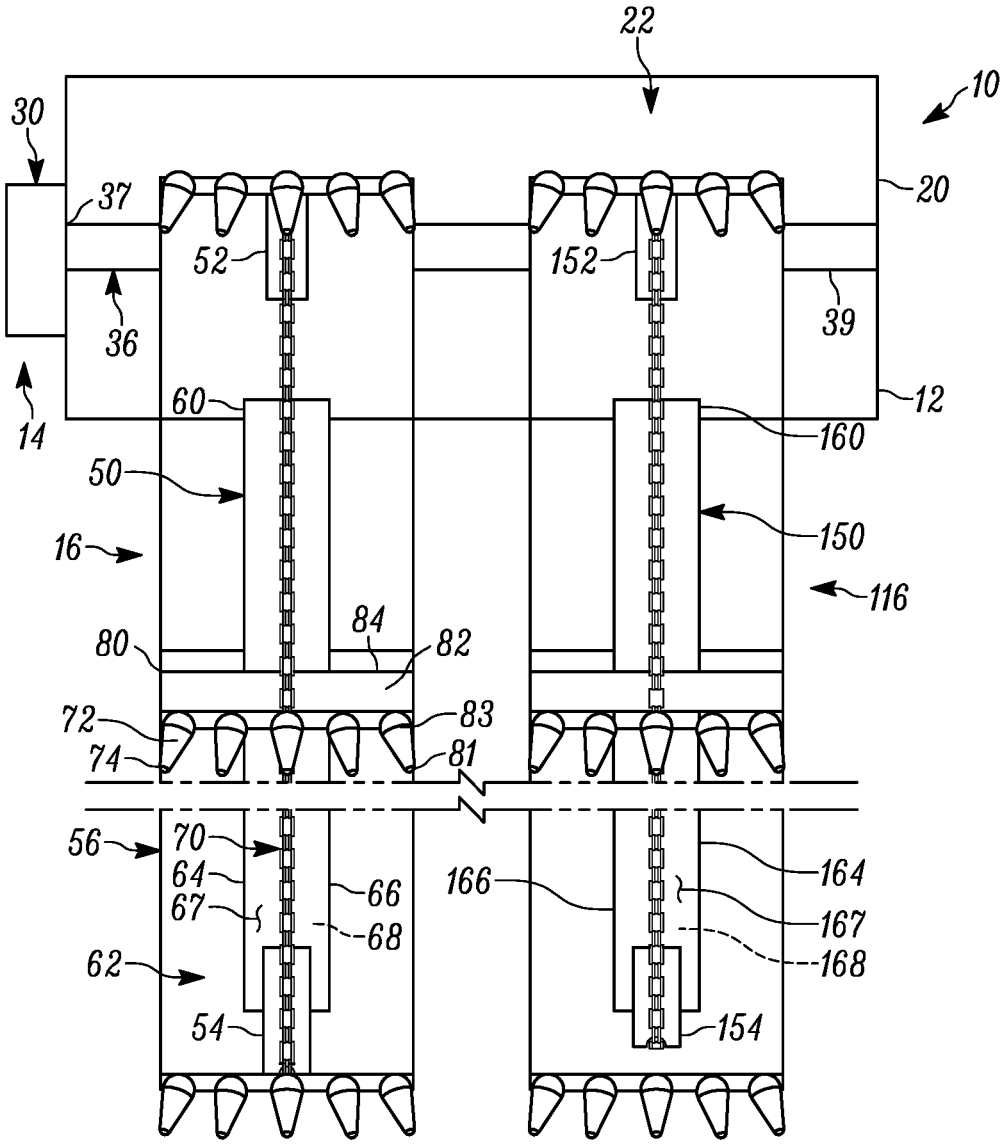
FIG. 3 of the drawings is a front cross-sectional view of a schematic representation of a boom assembly for a trencher of the present disclosure, showing, in particular, multiple boom arm assemblies.
Figure 4:
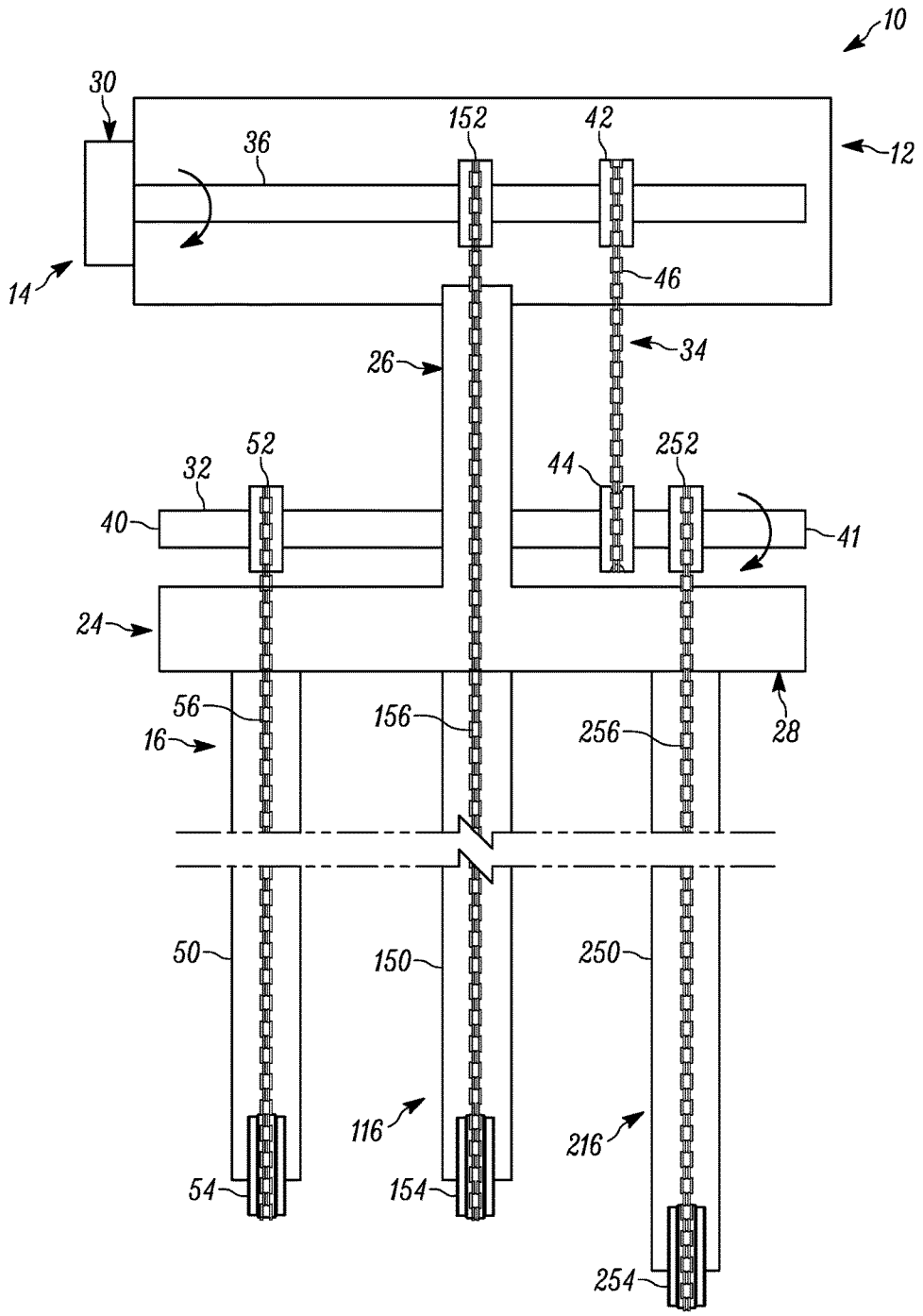
FIG. 4 of the drawings is a front cross-sectional view of a schematic representation of a boom assembly for a trencher of the present disclosure, showing, in particular, a boom mount assembly of the boom frame member of the boom assembly for a trencher of the present disclosure (it will be understood that the cutting support and cutting teeth have been omitted for pictorial clarity)
Figure 5:
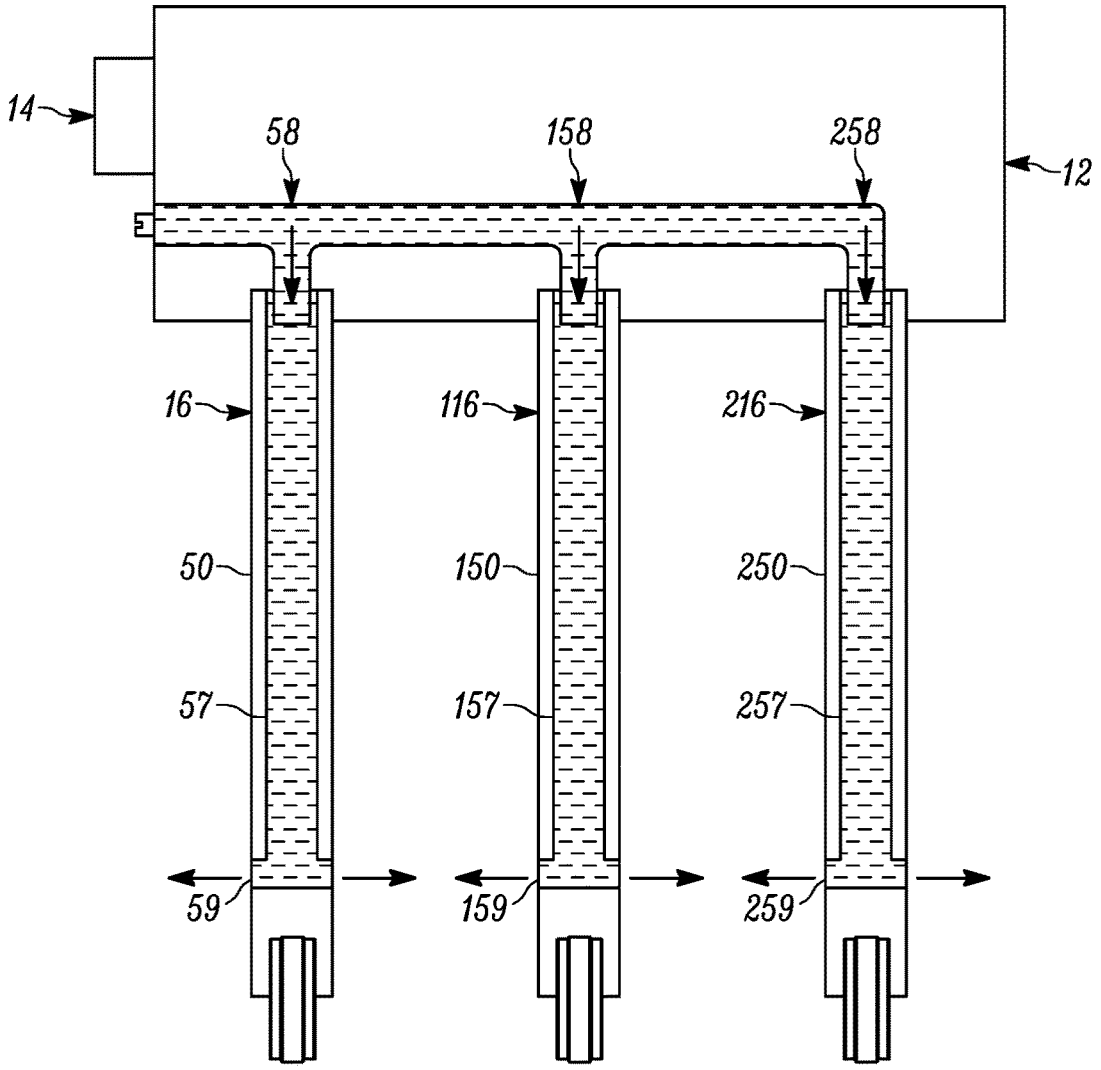
FIG. 5 of the drawings is a front cross-sectional view of a schematic representation of a boom assembly for a trencher of the present disclosure, showing, in particular, the inner bore of each of the boom arm assemblies.

The boom assembly 10 is shown in FIGS. 3 through 5 as comprising boom frame member 12, boom drive assembly 14 and boom arm assemblies 16, 116 and 216. It will be understood and explained below that while two or three boom arm assemblies are shown, it is contemplated that a greater or fewer number of boom assemblies may be contemplated for use. It will further be explained with respect to the exemplary trenches how different configurations of booms and different numbers of booms can form any number of different trench configurations.

Figure 10:
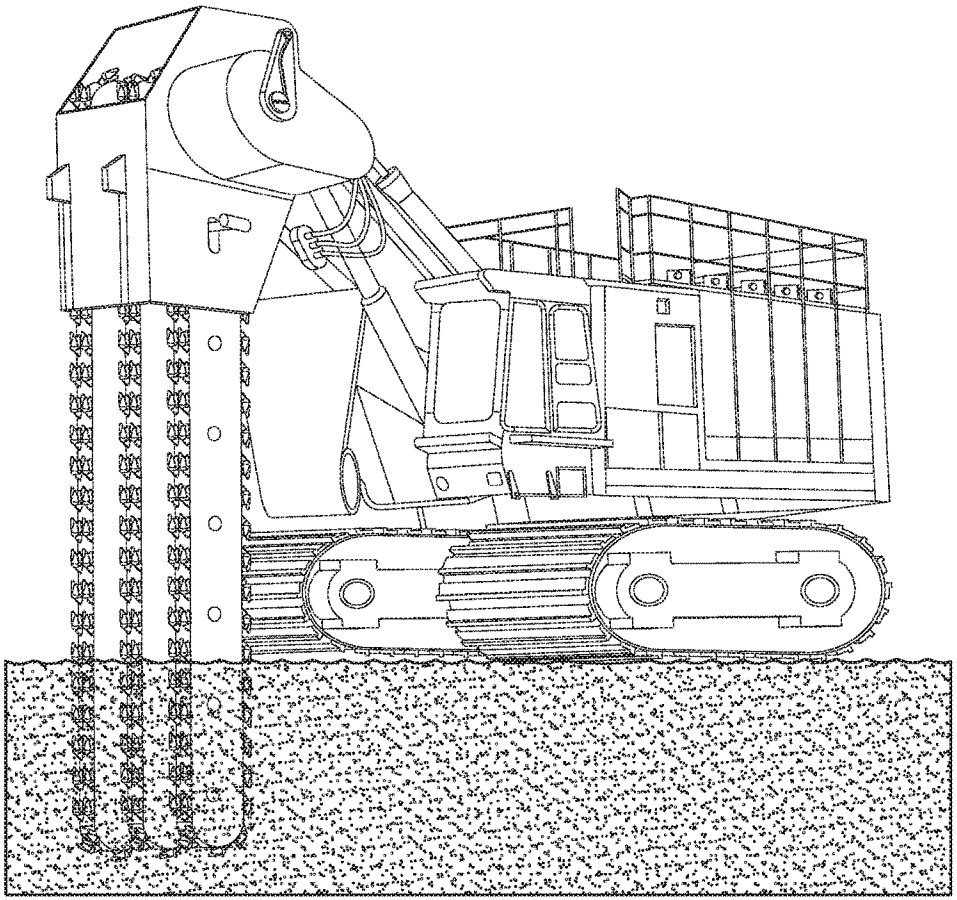
FIG. 10 of the drawings is a perspective view of a trencher having a boom assembly of the present disclosure.

As illustrated in FIGS. 3, 4, and 10 the boom assembly 10 includes a boom frame member 12, boom drive assembly 14, and first boom arm assembly 16. The boom frame member 12 includes enclosure walls 20, an inner cavity 22, and boom mount assembly 24. The boom frame member 12 is coupled to the end of the arm 104 of the trencher 100. In many instances, the boom frame member forms the distal end of the arm 104.

The enclosure walls 20 comprises a plurality of walls defining an inner cavity. In the configuration shown, the plurality of walls defines a downward opening generally rectangular cubic configuration, with spacing between the surfaces significant enough to allow placement and operation of the boom drive assembly 14. The inner cavity 22 may have any desired inner volume and dimension, understanding that it is of sufficient size and configuration to prevent contact and/or disruption to the proper operation of the boom drive assembly 14.

In the configuration of FIG. 4, and as will be explained below, in some configurations, the boom arm assemblies may be separately mounted to the boom mount assembly, in place of direct coupling to the boom frame member within the enclosure. In such a configuration, the boom mount assembly 24 extends distally from the enclosure walls 20 and, in many configurations, perpendicular to the boom drive assembly 14. The boom mount assembly further includes a drop beam 26 and upper support beam 28. The boom mount assembly 24 is mated to the enclosure walls by the drop beam 26 which connects, in the configuration shown, perpendicular and rigidly to upper support beam 28. The upper support beam is generally parallel to the output shaft of the boom drive assembly 14. Of course other configurations are contemplated by which the boom assemblies may be formed outside of the walls, in part or in whole, of the boom frame member. In the configuration of FIG. 3, on the other hand, the first end of the boom arm assemblies is positioned within the walls of the boom frame member.

With further reference to FIG. 4, the boom drive assembly 14 comprises a boom drive member 30, intermediate shaft 32, and power transfer mechanism 34. The boom drive member 30 has an output shaft 36 and comprises a first end 37 and second end 39, with the first end being proximate to the boom drive member (i.e., a hydraulic motor, electric motor, or other motive structure). The intermediate shaft 32 includes a first end 40 and second end 41 which is spaced apart from the output shaft. Power is transferred between the output shaft and the intermediate shaft through power transfer mechanism includes a first sprocket 42, second sprocket 44, and chain 46.

The output shaft 36 of the boom drive member 30 and intermediate shaft 32 are parallel to one another with the output shaft existing within the enclosure walls 20 the intermediate shaft 32 existing through the drop beam 26. The intermediate shaft 32 and boom drive member 30 rotate together, with the relative velocities (angular or linear) controlled by the power transfer mechanism 34. It will be understood that further intermediate shafts may be provided, each of which is powered through some type of power transfer mechanism (i.e., chain and sprocket, gear drive, etc.).

The power transfer mechanism's 34 first sprocket 42 aligns axially with the boom drive member 30 and is mated in such a way that the first sprocket 42 rotates together with the boom drive member 30 in unison through a keyed coupling, for example. The power transfer mechanism's 34 second sprocket 44 aligns axially with the intermediate shaft 32 and is mated in such a way that the second sprocket 44 rotates together with the intermediate shaft 32 in unison through a keyed coupling, for example.

The chain 46 aligns perpendicular to both the boom drive member 30 and intermediate shaft 32 and meshes with the sprockets. In more detail, chain 46 connects the first sprocket 42 and second sprocket 44 with a tangential attachment to each, mated in such a way that power driven by the boom drive member 30 is transferred through the first sprocket 42 to the second sprocket 44 via the chain 46 through traction.

It will be understood that in the configuration of FIG. 3, the intermediate shaft and the power transfer mechanism are not required, as the boom arm assemblies terminate within the enclosure 20 of the boom frame member 12.

With reference to FIGS. 3 through 6, the first boom arm assembly 16 comprises boom frame 50, upper boom sprocket 52, lower boom sprocket 54, cutting assembly 56, and, in some configurations, inner bore 57. The boom frame 50 includes a proximal end 60, distal end 62, first side surface 64, second side surface 66, outer surface 67, and inner surface 68. The proximal end 60 is positioned proximate the boom frame member (or within its enclosure) with the distal end spaced apart therefrom.

In more detail, the boom frame 50 includes proximal end 60 located proximate the boom drive member 30. As indicated above, the boom frame 50 is mated to the boom mount assembly 24 either directly to the enclosure 20, or to the boom mount assembly 24. The distal end 62 extends outwardly therefrom. In the configuration shown, the outer surface 67 is opposite the inner surface 68 and the first and second side surfaces are generally opposite of each other. In the configuration shown, the boom frame has a generally square cross-sectional configuration, while other configurations are contemplated.

The upper boom sprocket 52 can be axially mated to either the boom drive member 30, as shown in FIG. 3, or the intermediate shaft 32, as illustrated in FIG. 4, depending on the configuration, so as to be in a keyed (or otherwise mated) relationship therebetween. The lower boom sprocket 54 is located concentric with the distal end 62 and is mounted in a manner that allows rotational movement. The upper boom sprocket 52 and lower boom sprocket 54 rotate together by way of coupling therebetween the cutting chain of the cutting assembly 56. That is, the cutting assembly 56 through cutting chain 70 joins the upper boom sprocket 52 and lower boom sprocket 54 in rotation.

The cutting assembly includes a cutting chain 70, cutting support 72, and cutting teeth 74. The cutting support further comprises first side 80, second side 81, outer surface, 82, leading edge 83, and following edge 84. It will be understood that the cutting chain rotates about the upper boom sprocket and the lower boom sprocket with the cutting teeth cutting into the ground. It will be understood that the cutting support is generally mounted perpendicular to the direction of rotation of the cutting assembly with the cutting teeth mounted thereto. In many configurations, a plurality of cutting teeth may be mounted to each of the cutting supports, and that a plurality of cutting supports are positioned in a generally uniform configuration along the entirety of the cutting assembly. The cutting teeth may be replaceable separately from the cutting assembly, and may be easily removable and replaceable as necessary. It will be understood that there are a number of different configurations of the cutting teeth, and a number of different configurations are contemplated. In other configurations, the cutting teeth may be eliminated, and only a cutting support may be utilized.

The cutting assembly 56 moves via the chain that extends between upper boom sprocket 52 and lower boom sprocket 54. Cutting chain 70 is tangential to the upper boom sprocket 52 and lower boom sprocket 54, rotating with the leading edge 83 of the cutting support leading toward the distal end of the boom frame 50.

It will be understood that in some configurations, one of which is shown in FIG. 5, a slurry, or other flowable material (i.e., bentonite, or other clay-like materials, such as those identified above), may be shuttled to the distal end of the boom frame through the inner bore 57 that extends through the boom frame 50 generally between the first side surface 64, second side surface 66, outer surface 67, and inner surface 68. The first end 58 is located proximal on the first boom arm assembly with the second end 59 located on the distal end of the boom frame 50. In the configuration shown, at the second end, a plurality of outputs direct the flowable material through either side surface. Depending on the configuration, the inner bore may be omitted in some of the configurations. In other configurations, only some of the boom arm assemblies may include an inner bore.

It is to be understood that further addition of boom arm assemblies are to be labeled as second boom arm assembly 116, third boom arm assembly 216, and further as becomes necessary. The number of booms is variable and subject to change per the necessary application. Further, all related parts to the boom arm assembly 16 increase by values of 100. As an example, the boom frame 50 for the second boom arm assembly 116 would be the second boom frame 150. In the configuration shown in FIG. 3 a first boom arm assembly and a second boom arm assembly are shown. Each of the boom arm assemblies have a first end that extends into the inner cavity 12 with the distal end extending away therefrom. In the configuration of FIG. 4, a first boom arm assembly, a second boom arm assembly and a third boom arm assembly are shown, all positioned in a side by side configuration. In the configuration shown, the first and third boom arm assemblies have their respective proximal ends outside of the inner cavity 22, with the second boom arm assembly extending into the inner cavity. It will be understood that in other configurations, a greater number of boom arm assemblies may be utilized (i.e., there is essentially no particular limit as to the number of boom arm assemblies that are utilized). It will also be understood that all, some or none of the boom arm assemblies may have their proximal end within the inner cavity. That is, the inner cavity may be sized so as to accommodate more than two or three boom arm assemblies. On the other hand, each of the boom arm assemblies may be mounted to a boom mount assembly and may have their proximal end outside of the inner cavity 22.

Figure 6:
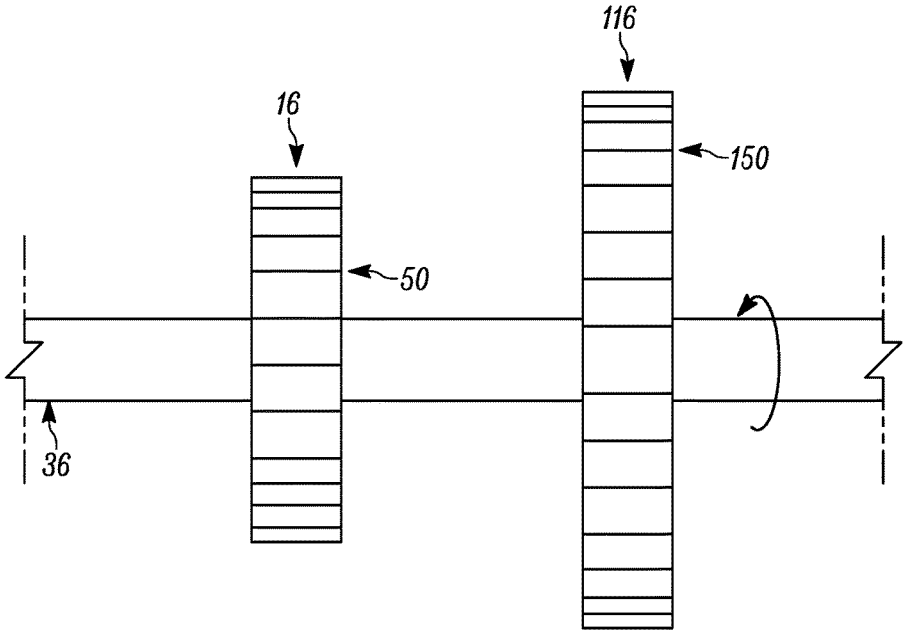
FIG. 6 of the drawings is a partial side elevational view of the output shaft having a first upper boom sprocket and a second upper boom sprocket of the respective boom arm assemblies of the boom assembly for a trencher of the present disclosure.

By having multiple different boom arm assemblies, a number of variations are possible between the different boom arms. For example, each of the boom arm assemblies may impart a linear speed on the respective cutting chain of the respective cutting assembly that is the same. Alternatively, as shown in FIG. 6, by varying the size of the upper boom sprocket (or the sprockets of the power transfer mechanism, as will be understood), variations can be introduced between the different boom arm assemblies. For example, some of the cutting chains may rotate faster than others of the cutting chains, or slower. Each cutting chain of each of the boom arm assemblies may have a linear speed that is different.

In other words, the first upper boom sprocket 52 and second upper boom sprocket 152 may be operated by the output shaft 36 or intermediate shaft 32. Both have rotational velocities operated by the boom drive member 30 which translates its velocity to cutting assembly 56 through traction of the upper boom sprocket 52. Direct velocity of the cutting assembly 56 may vary by altering the size of upper boom sprocket 52 and lower boom sprocket 54, as shown in FIG. 6. This allows for varying velocities between adjacent booms.

Additionally, as is shown in FIG. 4, for example, the different and adjacent boom arm assemblies, may have boom frames of different lengths (or heights, or depths). In the configuration shown, the first boom arm assembly is the shortest, followed by the second boom arm assembly, with the third boom arm assembly being the longest. Other configurations are contemplated, wherein each of the boom arm assemblies, or multiple ones of the boom arm assemblies are of the same length. In still other configurations, the lengths of each of the different boom arm assemblies may be the same. It will also be understood that the width of the adjacent boom arm assemblies, and corresponding cutting assemblies can be varied. The cutting assemblies need not be of the same width, or the same configuration.

Furthermore, while all of the boom assemblies are shown in FIGS. 1 through 5 as being substantially coplanar, it is contemplated that the different boom arm assemblies may be offset from each other so as to each be in a different plane (which planes are generally oblique to each other). For example, some of the boom arm assemblies may be in a first plane, with others in a second plane, third plane and so forth. In other configurations, all of the boom frames of the boom arm assemblies are positioned in the same plane. Additionally, while the boom arm assemblies are shown as being in a side by side configuration, with the boom frames all being substantially parallel to each other, it is contemplated that the boom frames may be slightly oblique to each other so as not to be parallel. Such a non-parallel configuration can be applied to instances wherein the boom arm assemblies are coplanar, as well as configurations wherein they are in different planes.

Referring again to FIG. 1, in operation, typically, the trencher 100 is directed to the starting location of a desired trenching operation. The boom drive assembly 14 is activated to initiate the rotation of the cutting assembly of each of the boom arm assemblies. Once initiated, the arm is directed in a manner to drive the boom arm assemblies into the ground. With reference to FIG. 2, typically, it is desirable to have the boom arm assemblies in a generally perpendicular orientation relative to the direction and position of the trench.

Once positioned as is shown in FIG. 2, the trencher can be traversed across the ground so as to direct the boom arm assemblies along the correct path of the trench that is to be formed. It will be understood that a slurry or flowable material may be directed through material feed member 108, or may be directed through the inner bores of the boom arm assemblies, as the trencher traverses the ground.

It will be understood that typically a trencher has a single boom arm assembly, configured to form a single trench of a predetermined width. Generally, where a trench is wider than the cutting assembly of the trencher, it is necessary to undertake a number of passes across the same ground to achieve the desired width. It will be understood, that for most applications where multiple passes are required, it becomes necessary to overlap adjacent passes. As such, where the trench is multiples of the width of the cutting assembly, it is contemplated that, due to overlap, a vastly greater number of passes are required. Additionally, wherein portions of the trench are required to be of different depth, it may be necessary to stop the process, and alter or replace the boom arm assembly (or provide a second trencher with a different boom).

Figure 7:
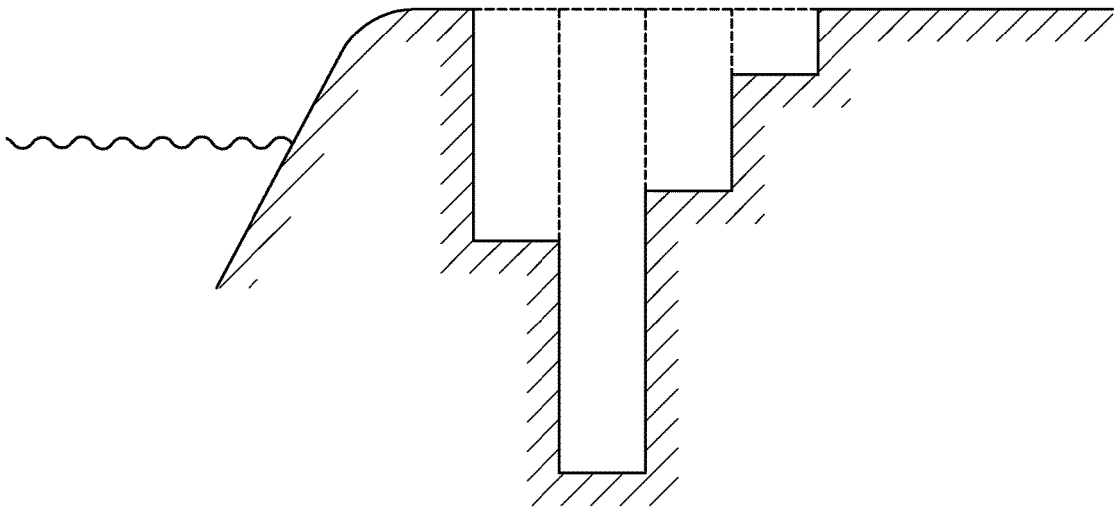
FIG. 7 of the drawings is a schematic representation of a trench formed with a trencher of the present disclosure.
Figure 8:
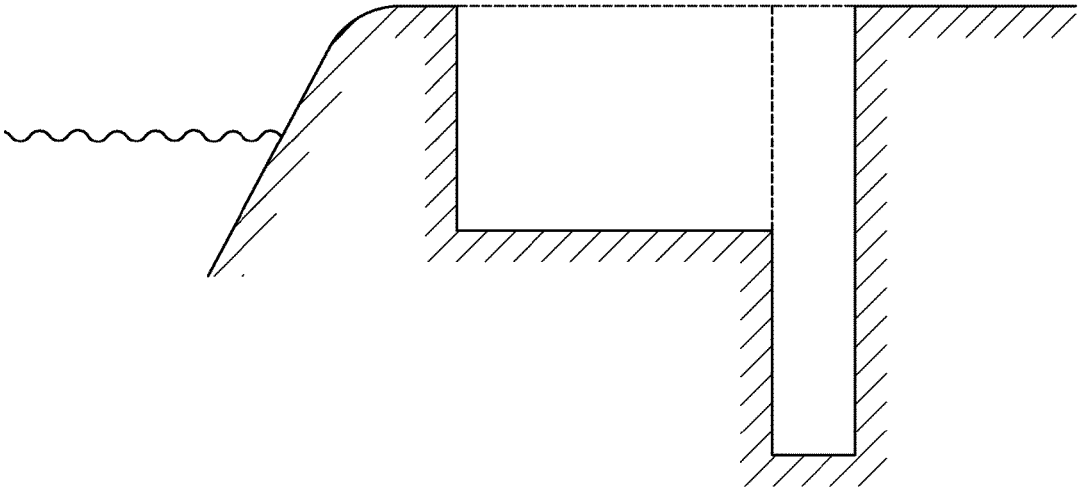
FIG. 8 of the drawings is a schematic representation of a trench formed with a trencher of the present disclosure.
Figure 9:
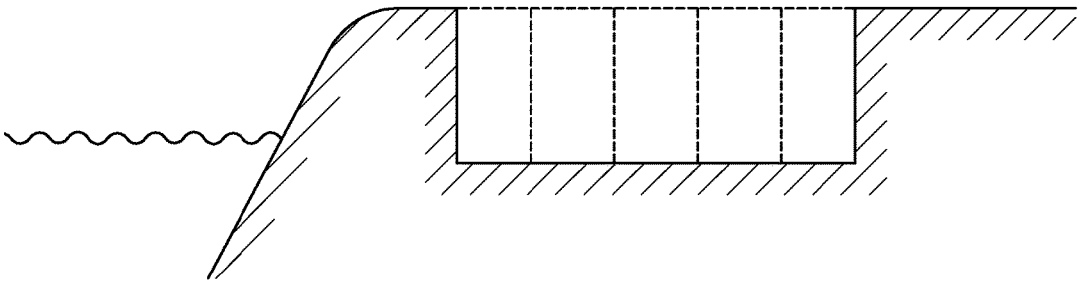
FIG. 9 of the drawings is a schematic representation of a trench formed with a trencher of the present disclosure.

On the other hand, where multiple boom arm assemblies are presented, it is possible, in a single pass of the trencher, to form a number of trenches and configurations, that are not possible with a single boom arm assembly. Some of such configurations are shown in FIGS. 7 through 9. In the trench of FIG. 7 a total of four boom arm assemblies were provided, with each of the boom arm assemblies having a different length of the boom frame. In such a configuration, the second from the left was the longest boom frame, with the final boom frame being the shortest. It will be understood that while the shortest and longest were positioned as shown, there is no particular limitation as to the position or configuration of each adjacent boom arm assembly. That is, the particular length of a boom arm assembly has virtually no bearing on the particular length of an adjacent boom arm assembly.

In the configuration shown in FIG. 8, two different depths of the trench are shown. Such a trench may be formed through the use of two boom arm assemblies, for example, a first boom arm assembly that has a cutting assembly of a width that is greater than the second boom arm assembly. At the same time, the first boom arm assembly is of a length that is shorter than the second boom arm assembly. In another configuration, three or more boom arm assemblies can be utilized. In such a configuration, one or more boom arm assemblies are utilized to form the region of relative less depth, and one or more boom arm assemblies are utilized to form the region of relative greater depth. In one particular configuration, three boom arm assemblies can be used to form the region of relatively less depth, with one boom arm assembly utilized to form the region of relatively greater depth.

In the configuration of FIG. 9, five separate boom arm assemblies can be utilized to form the relatively shallow trench shown therein. Each of the boom arm assemblies is configured to have an operational length that is the same. It will be understood that, in such a configuration, the different boom arm assemblies can have different linear speeds of the relative cutting assemblies. Additionally, it will be understood that, locally, a different flowable material can be utilized at each of the boom arm assemblies. In an alternate configuration, the trench shown in FIG. 9 could be formed through the use of two boom arm assemblies, one having a width that is, for example 50% greater than the other. In such a configuration, the first boom arm assembly forms ⅗ of the width of the trench with the other boom arm assembly forming the remaining ⅖ of the width of the trench.

It will be understood that the configurations of FIG. 7 through 9 are merely exemplary of the different configurations that are possible with the trencher of the present disclosure. These are not to be deemed limiting, as they represent but a small fraction of the different trenches that can be formed through the use of the present boom assembly. It will further be understood that variations such as increased boom arm assemblies and the like are contemplated, and the disclosure is not limited to two or three boom arm assemblies. Furthermore, the boom assembly is not limited to use in association with the particular trencher shown and described, and that a number of different trenchers and equipment are contemplated to which the boom assembly can be coupled.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A boom assembly configured for use in association with a trencher, the trencher comprising:

a body with an arm extending away from the body and being pivotable relative to the body, the arm having a distal end with the boom assembly positioned at the distal end thereof, the boom assembly comprising:

a boom frame member attached to the distal end of the arm of the trencher, the boom frame having a frame enclosure defining a cavity;

a boom drive assembly attached to the boom frame member, having an output shaft that is rotatably actuatable; and a plurality of boom arm assemblies extending from the boom frame member, the plurality of boom arm assemblies including at least a first boom arm assembly and a second boom arm assembly, the first boom arm assembly further including:

a first boom frame having a proximal end and a distal end, the proximal end positioned proximate the boom frame member, with the distal end spaced apart therefrom;

a first upper boom sprocket rotatably powered by the output shaft; and a first cutting assembly having a first cutting chain formed in a loop between the proximal end and the distal end of the first boom frame, and which interacts with the first upper boom sprocket, so as to be driven thereby;

the second boom arm assembly further including:

a second boom frame having a proximal end and a distal end, the proximal end positioned proximate the boom frame member, with the distal end spaced apart therefrom;

a second upper boom sprocket rotatably powered by the output shaft; and a second cutting assembly having a second cutting chain formed in a loop between the proximal end and the distal end of the second boom frame, and which interacts with the second upper boom sprocket, so as to be driven thereby, wherein the output shaft and the first and second upper boom sprockets are positioned within the cavity.

2. The boom assembly of claim 1 wherein the first upper boom sprocket and the second upper boom sprocket are positioned on the output shaft, and, in turn, rotate with the output shaft.

3. The boom assembly of claim 1 further comprising:

a boom mount assembly releasably coupled to the boom frame member;

an intermediate shaft having a first end and a second end, the intermediate shaft spaced apart from the output shaft and rotatably mounted to the boom mount assembly and coupled to the output shaft; and wherein at least one of the first and second upper boom sprockets are positioned on the intermediate shaft, to in turn, rotate with the intermediate shaft.

4. The boom assembly of claim 3 wherein the first boom arm assembly and the second boom arm assembly are attached to the boom mount assembly, so as to be releasably coupled to the boom frame member.

5. The boom assembly of claim 4 wherein the first boom arm assembly further includes a first lower boom sprocket, with the first cutting chain meshing therewith, the first lower boom sprocket positioned proximate the distal end of the first boom frame.

6. The boom assembly of claim 5 wherein the second boom arm assembly further includes a second lower boom sprocket, with a second cutting chain meshing therewith, the second lower boom sprocket positioned proximate the distal end of the second boom frame.

7. The boom assembly of claim 1 wherein the first cutting chain further includes a plurality of cutting supports attached thereto and extending substantially transverse to the first boom frame, with a plurality of cutting teeth attached to each of the cutting supports, the cutting teeth on a side of the boom opposite the trencher body being directed away from the upper sprocket and the cutting teeth on a side of the boom facing the trencher body being directed toward the upper sprocket.

8. The boom assembly of claim 7 wherein the cutting supports have a width that is greater than a width of the first boom frame.

9. The boom assembly of claim 1 wherein the first boom frame and the second boom frame are coplanar so as to be mounted in a side by side configuration.

10. The boom assembly of claim 1 wherein the first boom frame has a length and the second boom frame has a length, the length of the first boom frame being different than the length of the second boom frame.

11. The boom assembly of claim 1 further comprising a third boom arm assembly, the third boom arm assembly further comprising:

a third boom frame having a proximal end and a distal end, the proximal end positioned proximate the boom frame member, with the distal end spaced apart therefrom;

a third upper boom sprocket rotatably powered by the output shaft; and a third cutting assembly having a third cutting chain formed in a loop between the proximal end and the distal end of the third boom frame, and which interacts with the third upper boom sprocket, so as to be driven thereby.

12. The boom assembly of claim 1 wherein the first boom frame, the second boom frame and the third boom frame are coplanar so as to be mounted in a side by side configuration.

13. The boom assembly of claim 12 wherein the first boom frame has a length, the second boom frame has a length and the third boom frame has a length, the length of the first boom frame, the length of the second boom frame and the length of the third boom frame are each different.

14. The boom assembly of claim 1 wherein the first upper boom sprocket has a diameter and the second upper boom sprocket has a diameter, with the first upper boom sprocket having a diameter that is different than the second upper boom sprocket, to, in turn, impart a different linear velocity to the first cutting chain and the second cutting chain, respectively.

15. The boom assembly of claim 1 wherein the boom drive member comprises a hydraulic motor.

16. The boom assembly of claim 1 wherein at least one of the first boom frame and the second boom frame further includes an inner bore having a first end and a second end, the first end being positioned proximate the proximate end of the respective one of the first boom frame and second boom frame, and the second end being spaced apart from the proximal end and toward the distal end of the respective one of the first boom frame and the second boom frame, the inner bore being structurally configured to receive a flowable material therethrough.

17. The boom assembly of claim 16 wherein each of the first boom frame and the second boom frame each further include an inner bore.

* * * * *